US005120047A

United States Patent [19]

Mandel et al.

[11] Patent Number: 5,120,047

[45] Date of Patent: Jun. 9, 1992

[54] INTEGRAL SHEET STACKING BUCKLE SUPPRESSOR AND REGISTRATION EDGE

[75] Inventors: Barry P. Mandel, Fairport; Anthony T. DeSanctis, both of Rochester, N.Y.; Francesca A. Barrientos, Berkeley, Calif.; Richard A. VanDongen, Newark, N.Y.

[73] Assignee: Xerox Corporation, Stamford, Conn.

[21] Appl. No.: 651,881

[22] Filed: Feb. 7, 1991

[51] Int. Cl.[5] ..... B65H 31/34

[52] U.S. Cl. ..... 271/220; 271/236

[58] Field of Search ..... 271/178, 220, 221, 224, 271/236

[56] References Cited

U.S. PATENT DOCUMENTS

| | | | |
|---|---|---|---|
| 4,88,246 | 5/1989 | Wegel et al. | 271/182 |
| 3,847,388 | 11/1974 | Lynch | 271/174 |
| 4,087,087 | 5/1978 | Looney | 271/173 |
| 4,358,197 | 11/1982 | Kukucka et al. | 355/14 R |
| 4,428,666 | 1/1984 | Phelps et al. | 355/14 SH |
| 4,462,527 | 7/1984 | Taylor et al. | 226/15 |
| 4,640,505 | 2/1987 | Placke | 271/220 X |
| 4,778,170 | 10/1988 | Hynes | 271/253 |
| 4,836,527 | 6/1989 | Wong | 271/251 |
| 4,861,015 | 8/1989 | Stearns et al. | 271/213 |
| 4,883,265 | 11/1989 | Iida et al. | 271/220 |
| 5,014,977 | 5/1991 | Moore | 271/236 X |

OTHER PUBLICATIONS

Xerox Disclosure Journal; Thomas N. Taylor, et al.; "Document Registration with ski assisted Scuffer Wheel"; vol. 7, No. 6, Nov./Dec. 1982; pp. 371-372.

*Primary Examiner*—Richard A. Schacher

[57] ABSTRACT

In a sheet stacking system with top sheet input registration assistance by a scuffer, or the like, and a cooperative floating buckle suppression baffle or ski over the stack, this floating baffle can provide plural mode functions by providing an integral sheet stopping lip extending downwardly from the top of the stack along one edge thereof to provide stack edge registration and to prevent registration edge climbing of incoming sheets. Also disclosed is a spring or other flotation and mounting system for automatically maintaining a baffle spaced within a few millimeters above the top of said stack, and automatically moved up as incoming sheets are added to the top of said stack, to allow incoming sheets to be easily fed thereunder with low friction. Preferably the spacing is maintained by the scuffer position.

6 Claims, 3 Drawing Sheets

INTEGRAL SHEET STACKING BUCKLE SUPPRESSOR AND REGISTRATION EDGE

Cross-reference is made to a commonly assigned copending related application of substantially even date and inventors, application Ser. No. 07/651,879, entitled "Automatically Spaced Sheet Stacking Baffle".

The present invention relates to an improved sheet stacking system, in which flimsy sheets, such as copy sheets, are cumulatively stacked or compiled by being sequentially inputted and collected and also aligned with an edge alignment or stack registration system. Typically such sheet stacking alignment systems employ a scuffing, jogging, tamping, or other such edge alignment or stack registration system. The system disclosed herein provides improved reliability, yet with simplicity and low cost.

The present system provides for improved physical control of sheets of printed copy paper or other such flimsy and delicate sheets being stacked. In particular, with less danger of sheet edge misalignment, misstacking or damage.

Figure 2:
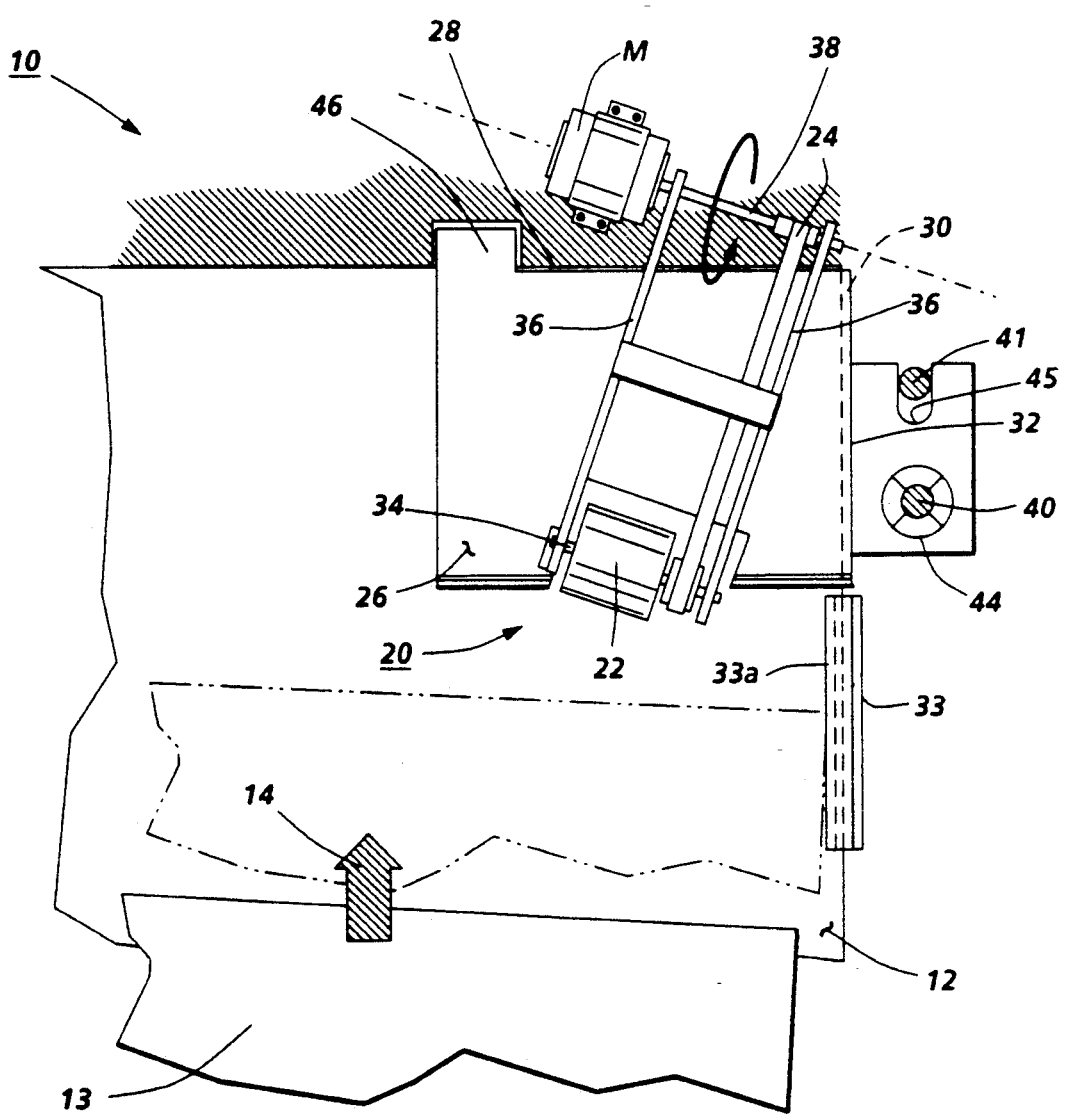
Figure 3:
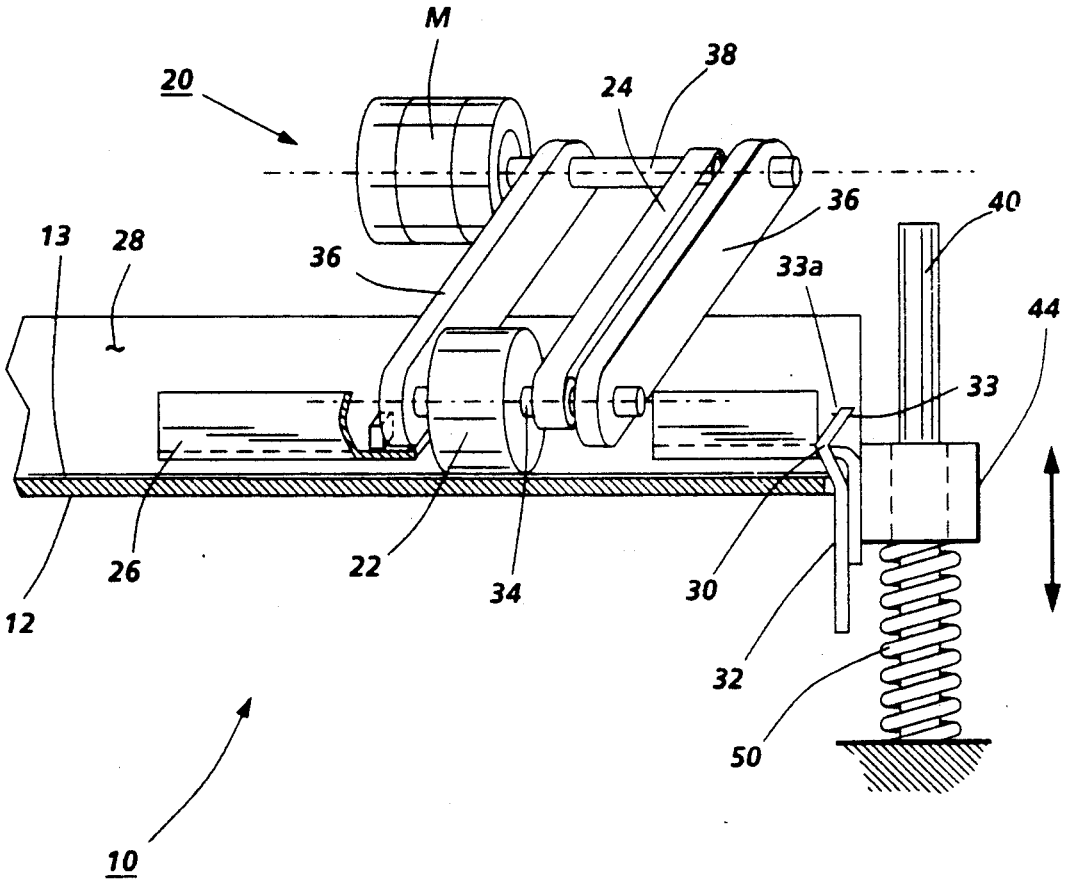

Of particular background interest, the particular exemplary compiling system embodiment illustrated herein is what is called a scuffer and sled type. Scuffer and sled types of compiling systems are known and used in general. They include those in which a "sled" or "ski", and an integral top-sheet engaging frictional sheet feed roller(s) known as a "scuffer", "floats" (by a pivotal mounting) on top of the accumulating sheet stack. The scuffer system helps to feed the incoming sheet under the ski up to a registration edge or wall proving stack alignment, at which point the "scuffer" slips relative to top sheet, hence its name. Usually the scuffer is angularly aligned to drive the incoming sheet towards one corner for registration alignment on two (both) axes. Noted by the applicants representative by way of examples in scuffer and sled types of compiling systems are Xerox Corporation patents U.S. Pat. Nos. 4,087,087 FIG. 7 issued May 2, 1978 to John H. Looney; 4,358,197 FIG. 4 issued Nov. 9, 1982 to W. P. Kukuka, et al; 4,462,527 FIGS. 2 and 3 issued Jul. 31, 1984 to T. N. Taylor, et al; 4,428,666 FIGS. 2 and 3 issued Jan. 31, 1984; and the "Xerox Disclosure Journal" Vol. 7, No. 6, November/December 1982, p. 371, by T. Taylor, et al. Such scuffer stacking systems have also been used commerically, for example, in the Xerox Corporation "8200", "9900" and "5090" copiers and printers to compile sheets for stapling. Also noted by the applicants representative was Eastman Kodak U.S. Pat. No. 4,861,015 on another scuffer system apparently without a ski, in which the end stop wall is apparently alternatively called a "striker plate". These cited prior systems provide additional disclosures of various alternative scuffer and/or sled apparatus, drives, and applications which may be modified as taught herein for the advantages disclosed herein.

The system disclosed herein provides greatly improved resistance to sheet end or lead corner "climbing" of the sheet registration or stopping walls or guides, which is particularly desirable for such a "scuffer" type of sheet compiling system. That sheet edge wall or striker plate climbing problem is believed to be a primary stacking failure mode of such "scuffer" type stacking registration systems, especially for thin, flimsy or curled-edge sheets. The exemplary system described herein desirably prevents registration edge wall climbing of sheets being stacked in such a system with a disclosed integral floating ski and registration edge wall system.

There are various such sheet stacking applications and needs, especially for the output of a copier or printer. One example is a stack compiling station, for set finishing such as by stapling, gluing or otherwise binding the stacked sheet set together, typically within or downstream of a single stacking bin. Another sheet stacking application is a plural bin sorter or collator for collating or collecting sheets of paper or the like into sets of sheets in respective such bins. In either case there is need for an improved system for actively moving (scuffing, jogging or tamping) the sheets being accumulated in the compiler tray or the sorter bins into a desired commonly aligned registration position, preferably without delaying or interfering with incoming sheets entering the bin(s).

Although the present system can be used with various stacking systems, including those which provide offsetting or lateral offsetting into job sub-sets of the sheets being stacked, the disclosed system is particularly desirable for a compiler stacking tray for a finisher. More positive and accurate stacking by sheet edge registration assistance has become even more desirable, especially for compiling. Sheets often enter a stacking tray with uneven lateral offset, or skew, or uneven sizes. In a compiler tray or area a stack of sheets must be closely stacked and neatly and evenly aligned to at least one edge for stapling, gluing or other binding or finishing operations, there or subsequently. Such set finishing per se is well known, as noted, e.g., in the patents cited in U.S. Pat. No. 4,782,363 at Col. 13 lines 1-27, inter alia.

In compiling, and many other sheet stacking processes, it is desirable to be able to stack from two sheets up to a large number of sheets in sets with very close stack registration dimensions, e.g., with all sheets in a set aligned or registered to within a fraction of a millimeter on at least one edge, to avoid ragged or uneven looking stack edges in the finished sets. Thus, a wide variation in stack heights must be accommodated by the edge registration system without affecting registration accuracy. It is desirable to be able to accommodate a wide range of stack heights and yet to be able to compile large sets or stacks of sheets (e.g., up to 250 or more sheets) without requiring adjustment or resetting of a scuffer, tamper or jogger or other compiler registration mechanism position relative to the stack or tray as the stack height changes.

It is also desirable to be able to stack and register sheets rapidly, in the short time available between rapidly sequentially fed sheets, as in a high speed printer, so as not to slow down the sheet production.

It is also desirable to be able to stack and register sheets with a relatively simple and low cost apparatus, yet with high reliability, absence of document edge damage or image smearing or operator danger, and accommodating a wide range of paper sheet sizes and weights and/or stiffness.

Integral compiling and stapling capability directly in a sorter bin itself is a known feature desirable in some post-collation copying or printing systems, in which pre-collation original document recirculation is not desirable or not available. I.e., plural bin sorters may have in-bin compiling and/or stapling capability. An exemplary sorter/stapler is the subject of Xerox Corporation U.S. Pat. No. 4,681,310, issued Jul. 21, 1987, to Thomas F. Cooper. A recent example of a bi-directional sorter with in-bin compiling and/or stapling capability is disclosed in Xerox Corporation U.S. Pat. No. 4,925,171 issued May 15, 1990 to Kramer, et al (D/87219). That patent also cites some other examples of providing on-line post-collation stapling by stapling sorted copy sets after they are sorted in the trays or bins of a copier. They include U.S. Pat. No. 4,083,550 issued Apr. 11, 1978 to R. Pal, and U.S. Pat. No. 4,762,312 issued Aug. 9, 1988 to Y. Ushirogatn (Ricoh), also disclosing moving a loaded bin of a sorter out from the bin array towards a stapler for stapling. Withdrawal of the sets from the bins with a gripper extractor for stapling elsewhere is shown for example in U.S. Pat. No. 4,361,393 to Noto. Showing directly in-bin stapling systems, with vertically moving bin bidirectional sorter bin arrays, are Xerox Corporation U.S. Pat. No. 4,681,310 to Cooper, and U.S. Pat. No. 3,995,748 to Looney. Also, Xerox Corporation U.S. Pat. No. 4,687,191 issued Aug. 18, 1987, and UK 2 173 483-A published Oct. 15, 1986, both by Denis Stemmle, are both on in-bin stapling. Edge jogging and glue binding sets in a sorter or collator is disclosed in Snellman et al U.S. Pat. No. 4,145,241. Hamlin et al U.S. Pat. No. 4,564,185 shows an on line rotary sorter copier unit with in-bin glue binding and/or stapling of the post-collated copy sets. U.S. Pat. No. 3,884,408 to L. Leiter et al. and U.S. Pat. No. 3,944,207 to Bains show a moving stapling system with a fixed horizontal bin array sorter. An example of a pivotal or swing-in stapler usable for in-bin stapling of a sheet set compiled in one accessible corner of the bin is disclosed in Xerox Corporation U.S. Pat. No. 4,830,256.

Although self-evidently of lessor interest to the disclosed system than the above-cited specific scuffer and sled type of stacking assistance art, an external prior art search by the Oliff firm noted the following U.S. patents re sheet end or edge registration systems: U.S. Pat. Nos. 4,778,170 to Hynes; 4,828,246 to Wegel et al; and 4,836,527 to Wong. Said U.S. Pat. No. 4,828,246 to Wegel et al uses a mechanism with downwardly inclined brush fiber bristles.

By way of further background, various other stacking assistance systems are known in the art for compilers, sorters, duplex stacking trays, etc.. They include additional paddle wheel or other scuffer types. E.g., Xerox Corporation U.S. Pat. No. 3,847,388 issued Nov. 12, 1974 to T. Lynch, or the driven flexible or floppy endless belt sheet aligning web member 50 disclosed in Canon U.S. Pat. No. 4,883,265 issued Nov. 28, 1989 to N. lida, et al., etc.. Some additional examples of active, in-bin active set jogging or scuffer registration system for sorters include the above-cited Xerox Corporation U.S. Pat. No. 4,087,087 issued May 2, 1978 to John Looney, and the Eastman Kodak Ektaprint 150PS bidirectional sorter tamper type jogging system. The latter has, at opposite (front and back) sides of the vertical sorter bin array, on opposite sides of the paper entrance path, a pivotally closing front stop gate vertical bar and a reciprocated rear vertical tamping bar, vertically extending past the front and back of all the bins, respectively. The rear bar is intermittently jogged towards the front bar when it is is in position to jog all the stacks in the bins. This relatively complex set registration system (which also restricts access to all the bins for set removal until this front stop gate is opened), is apparently operated to avoid obstruction of the paper entrance path to the bins, and illustrates advantages of the much simpler system disclosed herein. A resilient brush tamper arm corner jogger for a stapling bin is disclosed in Xerox Corporation U.S. Pat. No. 4,844,440, issued Jul. 4, 1989, to John R. Grey. Various other sheet stack edge joggers per se are also known, e.g. U.S. Pat. Nos. 4,318,541, 4,431,177, and 4,556,211.

The present system is not limited to any particular sorter or compiler system, and is applicable to various known or other sorters or compilers or other sheet stacking applications and functions.

A specific feature disclosed herein is to provide, in a sheet stacking and registration system for sequentially acquiring and stacking together filmsy sheets in an aligned stack in a sheet stacking tray or bin, with a sheet moving registration assistance system for assisting the sequential feeding of incoming sheets of paper or the like towards a sheet edge alignment position, and with a repositionable buckle suppression baffle means positionable at least partially closely overlying said stack for assisting said sequential feeding of incoming sheets by said sheet moving registration assistance system; the improvement wherein integral said repositionable buckle suppression baffle means is at least one integral sheet stopping edge registration extension member integrally extending downwardly from said position at least partially closely overlying said stack towards said sheet stacking tray at said sheet edge alignment position to register at least one edge of said stack to prevent edge climbing of said incoming sheets, which integral sheet stopping edge registration extension member is repositioned with said buckle suppression baffle means.

Other specific features disclosed, individually or in combination, include those wherein said repositionable buckle suppression baffle means and said integral sheet stopping edge registration extension member automatically moves up as a unit as said incoming sheets are sequentially added to the top of said stack; and/or wherein said sheet moving registration assistance system comprises a frictional scuffing system overlying and engaging the top sheet of said stack of sheets in said tray or bin, which frictional scuffing system automatically moves up, and allows said repositionable buckle suppression baffle means to move up, in response to sheets being sequentially added to the top of said stack thereunder; and/or wherein said sheet overlying buckle suppression baffle means comprises a floating ski plate closely overlying the uppermost sheet of said stack of sheets; and/or wherein said tray or bin is one of a plurality of sorter bins; and/or wherein said tray or bin is downwardly inclined towards said integral sheet stopping edge registration extension member for stacking assistance; and or wherein said sheet moving registration assistance system drives said incoming sheets towards one corner of said tray or bin to provide two-axis corner sheet registration with a single said sheet moving registration assistance system; and or wherein said sheet overlying buckle suppression baffle means has an extension of said integral sheet stopping edge registration extension member forward of the area overlying said stack, which forward extension has a bent lip which first bends sharply slightly inwardly towards said stack and is maintained adjacent the top sheet of said stack of sheets in said tray or bin, and which then bends flaringly outwardly, above said top sheet of said stack of sheets.

All references cited in this specification, and their references, are incorporated by reference herein where appropriate for appropriate teachings of additional or alternative details, features, and/or technical background.

Figure 1:
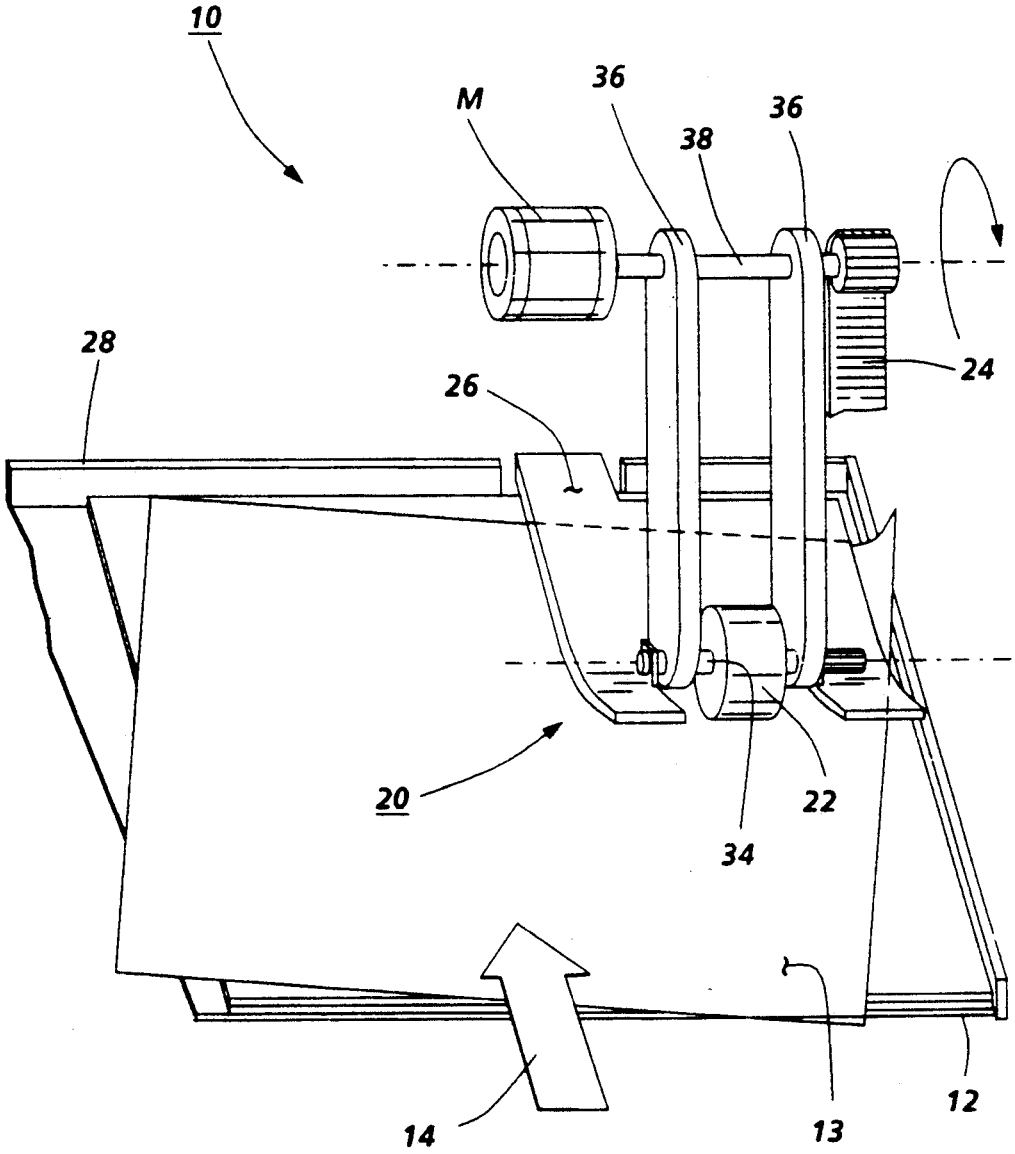
PRIOR ART FIG. 1

Various of the above-mentioned and further features and advantages of the invention will be apparent from the apparatus and its operation described in the specific example below. Thus, the present invention will be better understood from the following description of this exemplary embodiment thereof, including the drawing figure (approximately to scale) wherein:

FIG. 1, labeled "Prior Art", is an upper frontal perspective view of one example of a prior art floating scuffer and ski sheet compiler system, illustrating its subject failure mode, of the incoming sheet climbing one registration edge or wall;

FIG. 2 is a top view of one example of a sheet stacking registration system in accordance with the present invention, with an in-bin floating scuffer and ski system with integral sheet edge climbing prevention; and FIG. 3 is a frontal view of the embodiment of FIG. 2.

Describing now in further detail the specific example illustrated in the Figures, there is schematically shown in FIGS. 2 and 3 one exemplary compiler system 10 in a sheet stacking bin 12, into which are sequentially fed sheets 13 via a conventional or suitable sheet input path 14 not requiring illustration but generally indicated here by arrow 14. That sheet input 14 may, for example, be from the output of a copier or printer. That is well known, for example, from various of the well known Xerox Corporation copiers, as illustrated and described in various patents cited above and otherwise, such as U.S. Pat. No. 4,278,344, or various other xerographic or other copiers or printers. Only a single exemplary bin 12 is shown here, but it will be appreciated that the disclosed system 10 may be used in multi-bin sorters, as cited and discussed above. Likewise, although no stapler or other stacked sheet set finisher is shown, it will be appreciated that one or more may be provided, as discussed above, either in the bin 12 area or downstream thereof in a separate finisher into which the compiled and aligned set stack is transported from the bin 12 by movement of the set or the bin.

In this example, all of the sheets 13 being stacked in the bin 12 are both end and laterally (side) registered and aligned with the active assistance of the disclosed corner sheet registration active scuffing system 20, conventionally comprising a frictional roller 22 driven by motor "M" via belt 24 to frictionally drive the incoming (top) sheet being stacked under a generally horizontal floating ski, sled or guide 26. Conventionally, such a ski would be lying on top of the stack, i.e., floating directly on the then top-most sheet 13 of the stack. As will be described further below, here the ski 26 is preferably automatically maintained slightly above the top of the stack, closely spaced parallel thereto. Conventionally the ski 26 has a curved-up ski-like front edge to help capture the incoming sheet to be slid thereunder. The scuffer roller 22 continues to frictionally pull the front area of top sheet 13 under the ski 26 towards a sheet stopping and alignment position. That sheet alignment here is defined here by a rear alignment edge, wall, or striker plate 28, and a side or lateral registration position or line 30, to provide what is variously called full or corner or two-axes registration. [However, it is noted that the present system could also be used for one side or single axis alignment, with, for example, no rear registration 28]. Here, the side registration position 30 is defined by a generally vertical registration side stop wall or fingers 32, to be further described.

The details of the motor M or other scuffer actuation and mounting system 20 details are not important, since obviously various such known systems can be utilized. However, conventionally, the scuffer roller 22 and ski 26 are loosely pivotally connected together (to allow the ski 26 to self-align on the stack upper surface) at a common axis 34 at the inside end of a scuffer arm unit 36. Here, in contrast, in this preferred embodiment the scuffing system 20 is not fastened to the ski 26, and the ski is independently mounted. The only operative connection here is that the scuffing system 20 controls and limits the height of the ski 26. That is disclosed here by a downwardly projecting tab shown in FIG. 3 on the lowermost end; the arm 36 which serves as a limit stop to the upward movement of the ski 26 to maintain the ski 26 just above the bottom of the roller 22 and thus just above the top of the stack, as will be further discussed below. The position of the arm 36 and its tab is of course determined by the position of the connecting roller 22 which is weighted and/or spring loaded to always rest on top of the stack with a suitable feeding normal force irrespective of the stack height. The other end of the arm unit 36 conventionally pivotally mounts to a scuffing system pivotal axis 38. This pivotal axis 38 mounting allows the entire scuffing system 20 to "float" relative to the stack and continue to rise up as the stack builds up with more sheets. The motor M or other scuffer driving connection may be on the axis 38 and the drive belt 24 may extend between the axis 38 and the axis 34 to drive the scuffer wheel 22 about axis 34, as shown.

As is known, the ski or sled 26 helps hold sheets flat and minimizes buckling of the sheet between the scuffer roll 22 and the registration edge wall(s). That is, the conventional horizontal portion of the ski 26 functions as a buckle suppression baffle plate conventionally assisting the scuffing system 20. The prior systems were typically designed to minimize the space between the ski and the registration edge wall. However, the necessary relative movement there between to accommodate the floating up of the ski as the stack height increases required a gap or space there, through which gap the lead corner of sheets could escape and climb up the wall, causing the sheet to skew, all as shown in FIG. 1.

As shown in the modification of the compiler system 10 in FIGS. 2 and 3 for eliminating the above-described edge climbing failure mode, the floating ski 26 here also provides an integral dual mode function, providing an integral registration edge moving with the ski 26. Furthermore, a separate, fixed or outside registration wall is not required here. Here, a vertical downward (perpendicular) edge extension area 32 of the ski 26 provides the side registration position 30, by providing an integral generally vertical registration side stop wall (or fingers) 32 on the ski 26 itself at the desired side registration position 30. This can be a simple tab or bent wall extension of the same metal or plastic sheet from which the rest of the ski 26 is formed, and thus has little incremental cost. This integral registration stop wall 32 has no gap relative to the (rest of the) ski 26. Thus, there is a continuous registration surface and no opportunity for a sheet to escape there between, as in the prior art discussed above. Nor can the sheet climb up the wall 32, since the mating ski 26 main horizontal area continuously defines the top edge of the wall at the top of the stack. Thus, each sheet being stacked is fully captured. Not only is the top sheet registered, but also the registration of the underlying stacked sheets is maintained by the substantial downward extension of the floating wall 32 extending down along that stack edge.

Additionally, a forward extension 33 of the stop wall 32 may be provided forward (upstream) of the normal or horizontal area of the ski 26, in which a bent lip 33*a* extends in a sharp bend, first bending sharply but sightly inward towards the stack, at the stack level, and then bending or flaring outwardly, above the stack level. This "S" bent lip 33*a* resists previously stacked sheet climbing in the area in front of the ski 26 but allows and encourages incoming stacking of further sheets there. Such a sharp bend 33*a* could not be provided in a conventional fixed side wall, since such a horizontal surface variation would cause a similar stacking misalignment. However, here the bent lip 33*a* always floats up with the rest of the floating ski 26, to always be just above the top of the stack.

Another disclosed desirable feature here are vertical guide shafts or pins 40, 41, at the same side of the bin 12, mating with further, bearing, extensions 44, 45 of the ski 26 there. As shown, bearing 44 may be a conventional linear bearing, and bearing 45 may be a simple alignment notch in a horizontal lateral tab extension of the ski 26, to which tab extension bearing 44 may also be fastened. The shaft 40 and the linear bearing 44 thereon may be used to maintain the ski 26 parallel to the bottom of the bin 12 and thus parallel to the top of the stack yet allow its free vertical movement. Of course, other means may be provided for that.

An additional desirable feature disclosed here is a simple spring means 50 to support the weight of the ski 26, and keep it floating slightly above the top of the stack. As shown, the support spring 50 may be a simple coil compression spring under the bearing 44, or various other known spring configurations and/or locations. The spring 50 lifting force is preferably slightly greater than the weight of the entire ski 26 and its extensions noted above. This can greatly reduce undesirable drag between the incoming top sheet and the ski 26. As shown in FIG. 3, the spring 50 lift may desirably provide a small space between the ski 26 bottom and the top of the stack. Preferably a spacing of not more than a few millimeters. As described above, this ski 26 stack spacing may may be controlled and maintained by being limited by the scuffing system 20 position, by tab 36*a* or otherwise. One alternative for this, for example is a lose connection to the scuffer roller and ski common axis 34 via a short vertical slot allowing some relative vertical movement, as shown for example in the above-cited 1982 Xerox Disclosure Journal. The spring 50 force is less, of course, than that which would lift up the scuffer wheel 22.

Unlike a conventional ski, the rear or trail edge end of the ski 26 does not need to be spring and/or gravity biased downwardly, and the ski 26 does not have to be loaded down against the stack. However, a conventional rear horizontal tab extension 46 of the ski 26 beyond (through an aperture in) rear registration wall 28 is desirable, and is illustrated in FIG. 2.

Alternatively, this rear tab extension 46 of ski 26, or another, could be bent down, to extend downwardly, to define the rear sheet edge stacking alignment position, in lieu of, or in addition to, wall 28, in the same manner as the integral side stop extension 32 of ski 26 stops and registers the other edge of the sheets and their stack. In some systems, a stapler is in this area.

As an alternative, instead of a scuffer roller 20, a paddle wheel, swiper, or the like system may be used, such as those cited above. In that case, the support spring 50 may be desirably modified (reduced in strength) so that the ski 26 lightly rests on top of the stack.

Also, if desired, the bin (or bins) 12 may optionally have some vertical downhill inclination or slope, towards one or both of the registration edges, providing what is commonly called "downhill stacking". This provides some gravity stacking assistance and/or helps resist undesired accidental sheet shifting after stacking alignment.

Because the operation of the system 10 does not interfere with or obstruct bin 12 loading or unloading, its operation can be simple, flexible, and noncritical. It does not have to be tied in to or be interrupted or regulated by sheet position or bin entrance sensors.

It will be appreciated that various of the novel features disclosed herein may be utilized in combination with one another or alternatively utilized independently with alternative prior art or other components.

While the embodiment disclosed herein is preferred, it will be appreciated from this teaching that various alternatives, modifications, variations or improvements therein may be made by those skilled in the art, which are intended to be encompassed by the following claims:

What is claimed is:

1. In a sheet stacking and registration system for sequentially acquiring and stacking together flimsy sheets in an aligned stack in a sheet stacking tray or bin, with a sheet moving registration assistance system for assisting the sequential feeding of incoming sheets of paper or the like towards a sheet edge alignment position, and with repositionable buckle suppression baffle means positionable at least partially closely overlying said stack for assisting said sequential feeding of incoming sheets by said sheet moving registration assistance system; the improvement wherein integral said repositionable buckle suppression baffle means is at least one integral sheet stopping edge registration extension member integrally extending downwardly from said position at least partially closely overlying said stack towards said sheet stacking tray at said sheet edge alignment position to register at least one edge of said stack to prevent lateral side edge climbing of said incoming sheets, which integral sheet stopping edge registration extension member is repositioned with said buckle suppression baffle means; and wherein said sheet moving registration assistance system comprises a frictional scuffing system overlying and engaging the top sheet of said stack of sheets in said tray or bin, which frictional scuffing system automatically moves up, and allows said repositionable buckle suppression baffle means to move up above said top sheet, in response to sheets being sequentially added to the top of said stack under said scuffing system.

2. The sheet stacking and registration system of claim 1, wherein said sheet overlying buckle suppression baffle means comprises a floating ski plate closely overlying the uppermost sheet of said stack of sheets.

3. The sheet stacking and registration system of claim 1, wherein said tray or bin is one of a plurality of sorter bins.

4. The sheet stacking and registration system of claim 1, wherein said tray or bin is downwardly inclined towards said integral sheet stopping edge registration extension member for stacking assistance.

5. The sheet stacking and registration system of claim 1, wherein said sheet moving registration assistance system drives said incoming sheets towards one corner of said tray or bin to provide two-axis corner sheet registration with a single said sheet moving registration assistance system.

6. The sheet stacking and registration system of claim 1, wherein said sheet overlying buckle suppression baffle means has an extension of said integral sheet stopping edge registration extension member forward of the area overlying said stack, which forward extension has a bent lip which first bends sharply slightly inwardly towards said stack and is maintained adjacent the top sheet of said stack of sheets in said tray or bin, and which then bends flaringly outwardly, above said top sheet of said stack of sheets.

* * * * *